US006273672B1

(12) United States Patent
Charron

(10) Patent No.: US 6,273,672 B1
(45) Date of Patent: Aug. 14, 2001

(54) TWO-PHASE HELICAL MIXED FLOW IMPELLER WITH CURVED FAIRING

(75) Inventor: Yves Charron, Square Gabriel Faure (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/472,444

(22) Filed: Dec. 27, 1999

(30) Foreign Application Priority Data

Dec. 28, 1998 (FR) ..... 98 16521

(51) Int. Cl.[7] ..... F04D 3/02

(52) U.S. Cl. ..... 415/72; 415/199.4; 415/228; 416/177; 416/189

(58) Field of Search ..... 415/168.1, 199.4, 415/199.5, 228, 71, 72; 416/176, 177, 189

(56) References Cited

U.S. PATENT DOCUMENTS 4,097,186 * 6/1978 Budris ..... 415/143
5,100,295 * 3/1992 Madden ..... 416/175
5,997,242 * 12/1999 Hecker et al. ..... 415/72

FOREIGN PATENT DOCUMENTS 781929 7/1997 (EP) .
856665 8/1998 (EP) .
2333139 6/1977 (FR) .
2665224 1/1992 (FR) .
2697870 5/1994 (FR) .
2066898 7/1981 (GB) .

* cited by examiner

*Primary Examiner*—Edward K. Look
*Assistant Examiner*—Ninh Nguyen
(74) *Attorney, Agent, or Firm*—Antonelli, Terry, Stout & Kraus, LLP

(57) ABSTRACT

A compression or expansion two-phase helical mixed flow impeller (1) comprising one or more vanes (3) mounted on a boss, a cover (4) or fairing mounted on the outer part of the vanes, the assembly being arranged in a housing (2). The cover (4) has at least one of its ends corresponding to the inlet and/or the outlet of the impeller, a slop whose value is determined so as to limit leaks between the inlet and the outlet of the impeller.

9 Claims, 2 Drawing Sheets

TWO-PHASE HELICAL MIXED FLOW IMPELLER WITH CURVED FAIRING

FIELD OF THE INVENTION

The invention relates to two-phase helical mixed flow impellers and to compression and expansion devices comprising this type of impellers.

The invention notably relates to the following two-phase helical mixed flow impellers:

- helical axial flow impellers where the flow occurs in an essentially cylindrical shell, a subfamily of the helical mixed flow impellers (flow in a three-dimensional shell of revolution),
- compression impellers (energy transfer from the rotor to the fluid), for example, such impellers as those described in patent FR-2,665,224, and expansion impellers (energy transfer from the fluid to the rotor).

In the description hereafter:

- the meridian plane of an impeller refers to any plane passing through the axis of rotation,
- the radial plane of an impeller refers to any plane perpendicular to the axis of rotation,
- the channel of the impeller refers to the space through which the flow runs, edged with the vanes and with the inner and outer shells.

The impeller according to the invention is notably used in devices intended for compression and expansion of a mixture consisting of one or more liquid phases, of a gas phase and possibly of a solid phase.

It can be used in many fields, for example in petroleum production, geothermics, liquefaction processes (in particular liquefaction of natural gas), combined reinjection of water and acid gases, refining processes (catalytic reforming, hydrotreating: hydrocracking, hydrodesulfurization, etc).

BACKGROUND OF THE INVENTION

Single-phase compression and expansion radial (centrifugal) and mixed flow impellers are generally covered with an outer shell (cover or cap or fairing) so as to limit leak rates and recycle rates between the upper face and the lower face of the vanes and consequently to increase the impeller efficiency. These shells are generally provided, at one end thereof, with a seal (labyrinth seal for example) so as to limit leaks between the inlet and the outlet of the impeller as a result of the pressure gradient (positive in compression and negative in expansion) that appears during energy transformation.

Patent FR-2,697,870 describes the cover of vanes of compression helical axial flow impellers with a fairing itself covered on the total outer surface thereof by a seal system. The fairing has two purposes: first, it reduces the space between the rotor and the stator, considering the vane height reductions from the first to the last stage (volume flow rate reduction), second, it reduces leaks in the vicinity of each impeller while preventing friction losses by using a suitable seal system, for example grooves arranged in the direction of rotation.

SUMMARY OF THE INVENTION

The idea of the present invention is to place an additional element referred to as "cover" on the outer part of the vanes, which has, at least at one of its ends, a slope whose value is selected so as to limit leaks between the inlet and the outlet of the impeller.

The slope of the cover end where the pressure is the highest is notably so defined that there is a balance between the pressure force and the tangential component of the centrifugal force exerted on either side on a liquid mass M trapped between the cover and the stationary part.

The specific shape of the cover notably allows to obtain at least one of the following results:

- totally suppress the leak rate between the intrados and the extrados of the vanes of an impeller, and
- limit the leak rate outside the cover (from the outlet to the inlet in case of compression and from the inlet to the outlet in case of expansion), thus allowing to increase the efficiency of the stage.

The invention also consists in giving a specific shape to the mean curvature of the fluid flow channel in order to limit separation of the phases of the fluid.

The invention relates to a compression or expansion two-phase helical mixed flow impeller comprising one or more vanes mounted on a boss, a cover mounted on the outer part of the vanes, the assembly being placed in a housing. It is characterized in that the cover has, at least at one of its ends corresponding to the inlet and/or to the outlet of the impeller, a slope whose value is determined so as to limit leaks between the inlet and the outlet of the impeller.

The value of the slope(s) is so determined for example that there is a balance between the pressure force and the tangential component of the centrifugal force exerted on either side on a liquid mass trapped between the cover and the stationary part.

The value of the slope can be determined by means of a length Lz, said length Lz being at most equal to a maximum length Lmax.

This value Lmax is for example at most equal to about 20% of the axial length Lt.

According to an embodiment variant, the slope is situated at the high-pressure end of the impeller (the part of the impeller with the highest pressure).

The impeller can be a compression impeller or an expansion impeller.

The compression impeller or the expansion impeller can comprise at least one flow channel delimited by at least one boss and two successive vanes, said impeller having an axial length Lt and an mean radius of curvature Rh(z), taken in the meridian plane, said radius of curvature Rh(z) being suited, over at least part of length Lt, to limit separation of the phases of said multiphase fluid in the flow channel.

The invention also relates to a compression or expansion device for a multiphase fluid comprising at least one liquid phase and a gas phase, the device comprising a housing, one or more compression cells (Ii, Ri), the impellers being mounted on a shaft, an inlet allowing introduction of the multiphase fluid and an outlet for extracting the multiphase fluid that has gained a certain energy. The compressor is characterized in that at least one of the compression cells comprises an impeller as described above.

The compression impeller or device according to the invention is notably applied for petroleum effluent pumping.

BRIEF DESCRIPTION OF THE DRAWINGS

Other features and advantages of the invention will be clear from reading the description hereafter, given by way of non limitative example, with reference to the accompanying simplified drawings wherein.

DETAILED DESCRIPTION

Figure 1:
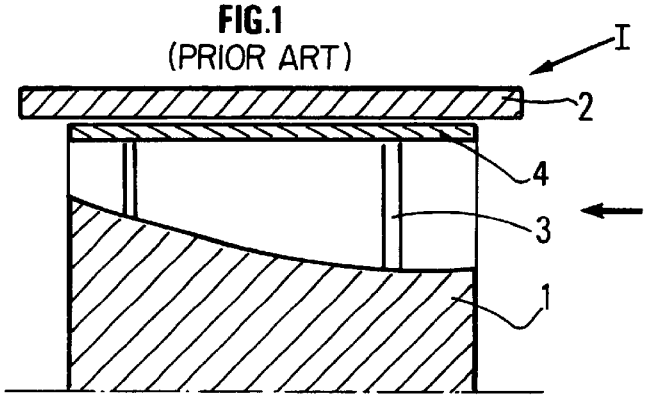
FIG.1 (PRIOR ART)
FIG. 1 diagrammatically shows an impeller provided with a cover according to the prior art.

FIG. 1 is a meridian section of a helical axial flow impeller provided with a cover according to the prior art.

Impeller I comprises a boss 1 provided with several vanes 3, a substantially cylindrical cover 4 fastened to the outer part of vanes 3. The assembly is placed in a housing 2.

The cover can also be provided, on its outer part, with a seal device placed between the cover and the inner wall of the housing (not shown in the figure).

Figure 2:
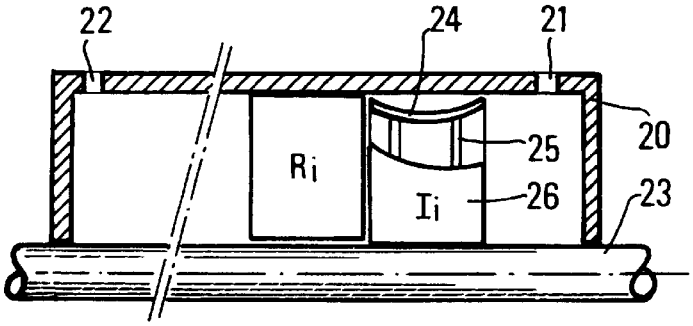
FIG. 2 is a general view of a compression device comprising at least one impeller provided with a cover comprising curved parts, FIGS. 3 and 4 diagrammatically show two cover variants for compression or expansion impellers.

FIG. 2 diagrammatically shows, in axial view, a non-limitative particular example of a pumping assembly comprising at least one impeller equipped with an additional cover or element presenting the specific features of the invention.

Such an assembly is for example used for pumping a multiphase petroleum effluent.

In this example, reference number 20 represents a housing in which several compression cells are arranged. Housing 20 comprises at least one inlet port 21 and at least one outlet port 22 for discharge of the multiphase fluid whose energy is to be increased.

A compression cell comprises for example an impeller Ii whose purpose is to increase the energy of the fluid and a diffuser Ri, index i corresponding to the rank of the compression cell. Impellers Ii are secured to a shaft 23 on which they are held in place according to means known to the man skilled in the art.

Figure 3:
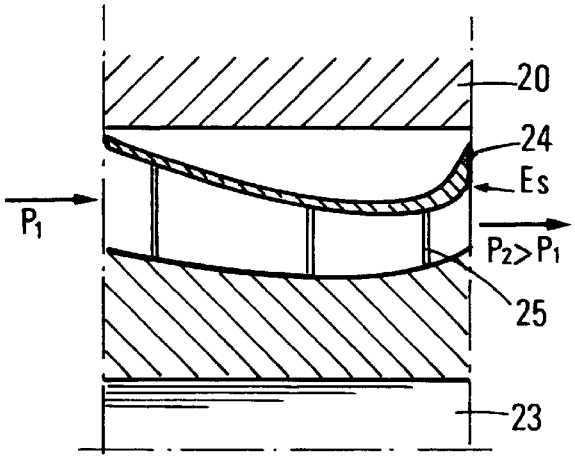

An impeller is equipped with a cover 24 (FIG. 3) mounted on the outer part of vanes 25, the latter being secured to a boss 26 (FIG. 3). The cover comprises, over at least part of its length, a slope whose value is defined so as to limit leaks between the inlet and the outlet of the impeller. The slope is for example positioned in the vicinity of the end of the cover that is subjected to the highest pressure, or high-pressure end.

The cover is for example defined by at least the following parameters:

- an outer surface Sext that is the closest to the housing wall,
- an inner surface Sint situated on the boss side,
- a thickness ec that can be constant when the shapes of the outer surface and of the inner surface are identical or substantially identical.

Boss 26, vanes 25 and inner surface Sint of the cover delimit a channel in which the multiphase fluid flows through the compression cells.

In general, a compression cell comprises a pair consisting of an impeller and a diffuser. It is however possible, without departing from the scope of the invention, to have a compression cell consisting of an impeller Ii that is not followed by a diffuser Ri.

Method of determining the cover slope

The slope of the cover according to the invention is defined at least at one of its ends so as to limit leaks between the inlet and the outlet of the impeller, by implementing for example the stages described hereafter.

The method describing limitation of the leaks on the outer part of the cover is implemented by comparing the forces exerted on either side of a quantity of liquid in the vicinity of the clearance between the cover and the housing.

Two types of impeller can be distinguished: compression impellers and expansion impellers.

a) Case of a Compression Impeller (FIG. 3)

Figure 4:
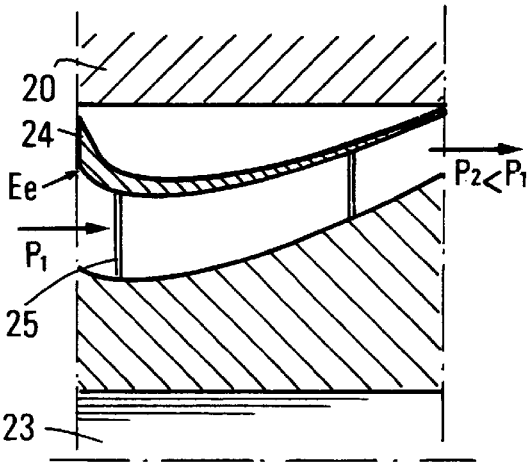

The outlet pressure $P_2$ being higher than the inlet pressure $P_1$ and leaks occurring from the higher to the lower pressure, limitation of the leaks is mainly applied at the impeller outlet and at least the slope of the cover in the vicinity of the impeller outlet is dimensioned. At the impeller inlet, the slope of the outer part of the cover can therefore be equal to the slope of the lower part of the cover, itself defined by the mean slope of the channel in the meridian plane.

b) Case of an Expansion Impeller (FIG. 4)

The outlet pressure $P_2$ being lower than the inlet pressure $P_1$ and leaks occurring from the higher to the lower pressure, limitation of the leaks is mainly applied at the impeller inlet and at least the slope of the part of the cover in the vicinity of the impeller inlet is dimensioned. At the impeller outlet, the slope of the outer part of the cover can therefore be equal to the slope of the lower part of the cover, itself defined by the mean slope of the channel in the meridian plane.

In general, the stages of the method consist in defining the slope of the cover by means of a length value or of an angle value so as to balance the force Fpj exerted by the pressure on the impeller side where the pressure is the highest and the force exerted by the centrifugal acceleration on the liquid mass contained in a revolution volume between the housing and the outer surface of the cover.

Index j corresponds to 1 for the impeller inlet and to 2 for the impeller outlet.

Figure 5:
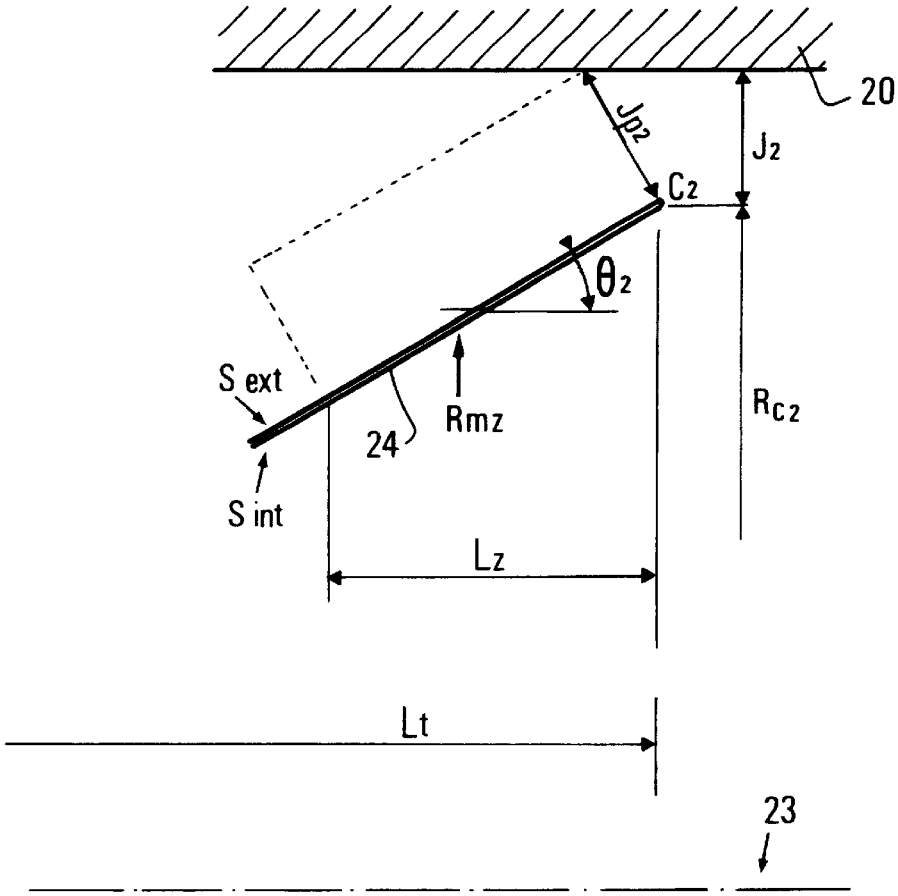
FIG. 5 is a diagram giving the parameters used to determine the value of the slope.

The method detailed hereafter (FIG. 5) is given for a compression impeller (case a)) by way of non limitative example.

Without departing from the scope of the invention, the calculation is applied in a similar way for an expansion impeller, calculation for defining the slope being then made at the impeller inlet.

We start from the following data:

- the rotating speed of the impeller, N expressed in revolutions per second,
- the distance between the outer part of the cover (point C) and the axis of rotation, Rc, at the impeller outlet, $Rc_2$,
- the angle formed by the tangent to the outer surface of the cover, at point C, with the axis of rotation in the meridian plane at the impeller outlet, $\theta_2$,
- the radial clearance between the cover and the stationary part, at the outlet, $J_2$,
- the pressure at the impeller outlet, $P_2$,
- the pressure at the impeller inlet, $P_1$.

A leak condition will appear at a rotating speed N, a radius $Rc_2$ and an angle $\theta_2$. Leaks tend to decrease when angle $\theta_2$ increases.

To begin with, the outer shape of the cover is assumed to be identical to the outer shape of the channel.

The following parameters are for example calculated at the impeller outlet.

Given parameters

Clearance height in a direction perpendicular to the cover surface:

$$Jp_2=J_2/\cos(\theta_2)$$

Surface of revolution of the clearance perpendicular to the cover surface:

$$Sj_2=2*\pi*Rc_2*Jp_2.$$

Determination of the force exerted by the pressure

Force exerted by the pressure, from the outlet to the inlet of the impeller in the vicinity of the clearance:

$$Fp_2=Sj_2*(P_2-P_1)$$

Centrifugal acceleration at radius $Rc_2$:

$$Ax_2=(2*\pi*N)^2*RC_2.$$

Determination of the force exerted by the centrifugal acceleration on the fluid mass The component of the centrifugal acceleration tangentially to the cover is:

$$Ac_2=Ax_2*\sin(\theta_2)$$

The volume of revolution V delimited by the outer surface of the cover, a shell parallel to this surface taken at a distance $Jp_2$, over an axial length Lz, is defined by:

$$V=2*\pi*Rmz*Lz*Jp_2,$$

Rmz being the mean outer radius of the cover over length Lz.

The mass of the fluid volume contained in the corresponding volume of revolution is:

$$M=V*\rho o$$

where ρo is the density of the liquid.

The force exerted by the centrifugal acceleration on the fluid mass M contained in the volume of revolution is:

$$Fc=Ac_2*M=Ax_2*\sin(\theta_2)*2*\pi*Rmz*Lz*Jp_2*\rho o.$$

The value of the slope to be given to the part of the cover situated at the impeller outlet is deduced from these two force values and from the desired balancing condition for preventing leaks. The value of the slope is given by means of value Lz or of the value of angle θ.

The value of Lz is for example deduced from the previous equality:

$$Lz=Rc_2*(P_2-P_1)/Rmz/Ax_2/\sin(\theta_2)/\rho o:$$

We check that the value of Lz is smaller than a maximum value Lmax,

- if Lz≦Lmax, then the corresponding value of angle $\theta_2$ is acceptable,
- if Lz>Lmax, the value of the angle is increased until a value of Lz less than or equal to Lmax is obtained.

The value of Lmax is for example equal to about 20% of the axial length of the impeller, Lt.

Figure 6:
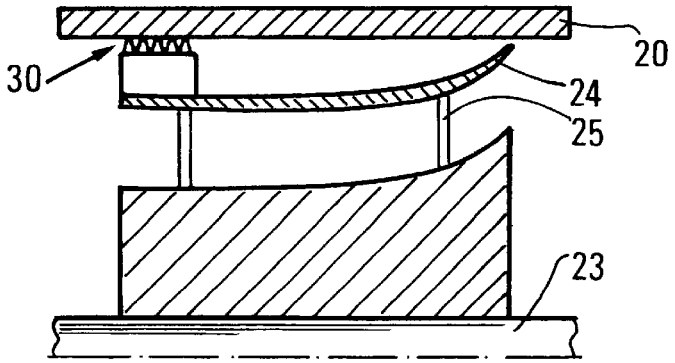
FIG. 6 shows an embodiment variant comprising additional seal means.

FIG. 6 diagrammatically shows a variant of a helical axial flow impeller provided with a cover fastened to the outer part of the vanes. The cover has a conical or slightly curved part, in a meridian plane, at one end of the impeller (the inlet in the figure) and a curved part, in a meridian plane, at the other end (the outlet in the figure). This layout is more particularly suited for a compression helical axial flow impeller with, for example at the inlet, an axial absolute velocity (leading only to little separation of the phases at the inlet) and, at the outlet, a greatly deviated absolute velocity (resulting from the energy transformation and leading to a great phase separation, especially in the presence of rectilinear channels, in a meridian plane).

The upstream part of the cover, in relation to the direction of flow of the fluid, is equipped, on its outer part, with a seal system 30 such as a labyrinth system in order to limit leaks on either side of the impeller ends. Dimensioning of such a (ring-type, labyrinth or other) seal system is performed by means of methods known to the man skilled in the art.

The conical (or slightly curved) and curved parts of the cover can be reversed between the inlet and the outlet according to the function (compression or expansion) and to the design of the impeller (great accelerations at the impeller inlet or outlet).

Numerical Example Concerning Limitation of Leaks Between the Cover and the Housing, at the Impeller Outlet, According to the Slope of the Channel in the Meridian Plane Data:

- Impeller rotating speed N: 100 rps
- Distance from the cover to the axis of rotation: $Rc_2$=0.125 m
- Angle formed by the cover with the axis of rotation in the meridian plane at the impeller outlet: 25°
- Clearance between the cover and the stationary part (at the outlet): $J_2$=0.00045 m
- Pressure downstream from the impeller: $P_2$=1 MPa abs
- Pressure upstream from the impeller: $P_1$=0.8 MPa abs.

All the values below are calculated at the impeller outlet (unless otherwise stated)

Clearance height in a direction perpendicular to the cover surface:

$$Jp_2=J_2/\cos(25)=0.0005 \text{ m}.$$

Surface of revolution of the clearance perpendicular to the cover surface:

$$Sj_2=2*\pi*Rc_2*Jp_2=0.000392 \text{ m}^2.$$

Force exerted by the pressure from downstream to upstream in the vicinity of the clearance:

$$Fp_2=Sj_2*(P_2-P_1)=78N.$$

Centrifugal acceleration at radius $Rc_2$:

$$Ax_2=(2*\pi*N)^2*Rc_2=49{,}300 \text{ m/s}^2.$$

Component of the centrifugal acceleration parallel to the cover:

$$Ac_2=Ax_2*\sin(25)=20{,}835 \text{ m/s}^2.$$

The balance between the pressure force and the force corresponding to the centrifugation of a liquid mass M (volume V and density ρo) trapped between the cover and the stationary part is reached when: $Fp_2=M*Ac_2$, i.e. when M=0.0037 kg, i.e. a volume of $3.7.10^{-6}$ $m^3$ for a liquid density of 1000 kg/$m^3$. This liquid volume corresponds to an axial length of the order of some mm (this value can be compared with the axial length of the impeller, of the order of some cm), the length being precisely determined according to the slope, but also to the curvature of the cover.

Calculation shows that, from a certain liquid accumulation outside the cover (volume between the rotating cover and the stationary part), the component of the centrifugal acceleration parallel to the inclined cover is sufficient to oppose the pressure force. When the forces are balanced, no fluid exchange occurs in the vicinity of the clearance between the impeller and the stationary part.

The cover described in FIGS. 2 to 6 can be placed on the outer part of the vanes of an impeller comprising a flow channel for which the mean radius of curvature for example is determined according to the method described in patent application FR-98/16,522 entitled "two-phase impeller with curved channel in the meridian plane". The specific shape of this radius of curvature notably allows to limit separation of the phases of a multiphase fluid.

We start from an expansion or compression impeller provided with a cover having a slope corresponding respectively to an angle value θ1 or θ2 obtained by means of the aforementioned calculation stages.

Summary of the Stages of the Calculation Method for Determining the Value of the Mean Curvature to be Given to the Flow Channel We start from an impeller having a known initial radius of curvature, the value Anc(z) is known for all the values of z. Anc(z) corresponds to the radial acceleration and to a non-curved channel in the meridian plane taking account of various accelerations given in the aforementioned patent application.

We try to minimize value $A_T$. The new mean radius of curvature of the channel in a meridian plane is for example determined as follows:

with Z=0 defining the channel inlet and Z=1 defining the outlet, point $Z_0$ corresponding to the minimum value of Anc(z) is determined, with $Z=Z_0$, a zero slope ($T(Z_0)=0$) is for example selected in the meridian plane for the shell Cmoy (mean shell of the channel that corresponds to the mean path followed by the fluid flow). Without departing from the scope of the invention, it is possible to take a value different from 0 without changing the procedure for calculating Rh(Z), a starting value At_max=At_max_1 valid for all the values of z is selected, Ac(z) is calculated.

The known value of Anc(z) is compared with the value of At_max.

Two cases, a) and b), may arise:

a) Anc(z)<=At_max, then Ac(z) can have any value ranging between 0 and At_max −Anc(z) with $$Rh(z) = -\frac{(W\sin\beta)^2\cos\gamma}{Ac(z)}$$

and one of these values is selected. Under this condition, Rh(z) is negative and the concavity of shell Cmoy is directed towards the negative x, b) Anc(z)>At_max, then Ac(z)=At_max −Anc(z) with $$Rh(z) = -\frac{(W\sin\beta)^2\cos\gamma}{Ac(z)}.$$

Under this condition, Rh(z) is positive and the concavity of shell Cmoy is directed towards the positive x.

When going for example from point $Z_0$ to the channel inlet, a slope $T_1$ is obtained at the inlet for shell Cmoy, and similarly for example from point $Z_0$ to the outlet with a slope $T_2$ at the outlet. The curvature of the impeller is thus determined at any point. Two angle values γ1 and γ2 correspond to slopes $T_1$ and $T_2$.

At any point, angle γ corresponding to slope T(z) must range between −90 and +90 degrees. During the calculation procedure, if the angle becomes less than −90 degrees or greater than 90 degrees at any point, the initial value of At_max is decreased and calculation is reiterated until an angle value ranging between −90° and 90°, [γ1, γ2], is obtained.

For reasons specific to the function of the impeller (compression, expansion, or other specific applications), if the absolute values of the slopes are too great, the initial value of At_max is decreased and calculation is reiterated until an angle value ranging between −90° and 90° is obtained.

It is possible to select different values for At_max between the inlet and the outlet of the channel.

According to the nature of the impellers and to their function (compression, expansion or other applications), it is possible to define, for angles γ1,γ2 corresponding to slopes $T_1$ and $T_2$, values that are different from the aforementioned values −90 °, 90°.

Selection of the values of θ1 and θ2

If $|\theta j| \geqq |\gamma j|$, the impeller is defined by the two angles θj for the cover and γj for the channel, if $|\theta j| < |\gamma j|$, one of the values ranging between $[|\theta j|;|\gamma j|]$ is taken as the angle value θj for the cover, with j=1 for the inlet of an impeller (for example an expansion impeller—FIG. 4) and j=2 for the outlet of an impeller (for example a compression impeller—FIG. 3).

A compression impeller comprising an inlet section and an outlet section, at least one flow channel delimited by at least one boss and two successive vanes is for example defined. The impeller has an axial length Lt and a mean radius of curvature Rh(z) (in the meridian plane), said radius of curvature Rh(z) being suited, over at least part of length Lt, to limit separation of the phases of said multiphase fluid in the channel.

The diameter of the housing can be constant over the total length or variable.

The number, the thickness and the material of the vanes, as well as the thickness and the material of the cover, are determined so as to ensure integrity of the system considering the mechanical stresses exerted on the inner parts of the impeller and resulting mainly from the rotating speed and from the torque transmitted. These calculation methods are known to the man skilled in the art.

The number, the thickness and the angles of the vanes are determined on the hydraulic plane according to the state of the art or to prior patents.

What is claimed is:

1. A compression or expansion two-phase helical mixed flow impeller comprising one or more vanes (25) mounted on a boss (26), a cover (24) mounted on the outer part of the vanes, the assembly being placed in a housing (20), characterized in that the cover has, at least at one of the ends thereof corresponding to an inlet and/or to an oulet of the impeller, a slope whose value is determined so as to limit between the impeller inlet and outlet.

2. An impeller as claimed in claim 1, characterized in that the value of the slope(s) is determined so as to have a balance between the pressure force and the tangential component of the centrifugal force exerted on either side on a liquid mass trapped between the cover and the stationary part.

3. An impeller as claimed in claim 1, characterized in that the value of the slope is determined by means of an axial length Lz of said cover.

4. An impeller as claim in claim 3, characterized in that said axial length Lz being at most equal to about 20% of axial length Lt of the impeller.

5. An impeller as claimed in claim 1, comprising a slope situated at the high-pressure end of the impeller.

6. A compression impeller as claimed in claim 1, comprising at least one flow channel delimited by at least one boss and two successive vanes, characterized in that said impeller has an axial length Lt and a mean radius of curvature Rh(z), taken in the meridian plane, said radius of curvature Rh(z) being suited, over at least part of length Lt, to limit separation of the phases of said multiphase fluid inside the channel.

7. An expansion impeller as claimed in claim 1, characterized in that it comprises at least one flow channel delimited by at least one boss and two successive vanes, characterized in that said impeller has an axial length Lt and a mean radius of curvature Rh(z), taken in the meridian plane, said radius of curvature Rh(z) being suited, over at least part of length Lt, to limit separation of the phases of said multiphase fluid inside the channel.

8. A compression or expansion device intended for a multiphase fluid comprising at least one liquid phase and a gas phase, the device comprising a housing (20), one or more compression cells (Ii, Ri), the impellers being mounted on a shaft (23), an inlet allowing introduction of the multiphase fluid and an outlet allowing extraction of the multiphase fluid that has gained a certain energy, characterized in that at least one of the compression cells comprises an impeller as claimed claim 1.

9. Use of the impeller as claimed in claim 8 for pumping a petroleum effluent.

* * * * *

UNITED STATES PATENT AND TRADEMARK OFFICE

CERTIFICATE OF CORRECTION

PATENT NO. : 6,273,672 B1
DATED : August 14, 2001
INVENTOR(S) : Yves Charron

It is certified that error appears in the above-identified patent and that said Letters Patent is hereby corrected as shown below:

Column 8,
Line 43, replace:

1. A compression or expansion two-phase helical mixed flow impeller comprising one or more vanes (25) mounted on a boss (26), a cover (24) mounted on the outer part of the vanes, the assembly being placed in a housing (20), characterized in that the cover has, at least at one of the ends thereof corresponding to an inlet and/or to an outlet of the impeller, a slope whose value is determined so as to limit between the impeller inlet and outlet.
Replace with:
-- 1. A compression or expansion two-phase helical mixed flow impeller comprising one or more vanes (25) mounted on a boss (26), a cover (24) mounted on the outer part of the vanes, the assembly being placed in a housing (20), characterized in that the cover has, at least at one of the ends thereof corresponding to an inlet and/or to an outlet of an impeller, a slope whose value is determined so as to limit leaks between the impeller inlet and outlet. --

Signed and Sealed this

Twenty-seventh Day of August, 2002

*Attest:*

*Attesting Officer*

JAMES E. ROGAN
*Director of the United States Patent and Trademark Office*